US008663374B2

(12) United States Patent
Pant et al.

(10) Patent No.: US 8,663,374 B2
(45) **Date of Patent: *Mar. 4, 2014**

(54) ELECTROSTATIC AEROSOL CONCENTRATOR

(75) Inventors: Kapil Pant, Madison, AL (US); Shivshankar Sundaram, Tampa, FL (US); Yi Wang, Madison, AL (US)

(73) Assignee: CFD Research Corporation, Huntsville, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/566,297

(22) Filed: Aug. 3, 2012

(65) Prior Publication Data

US 2013/0192462 A1 Aug. 1, 2013

Related U.S. Application Data

(63) Continuation of application No. 11/831,613, filed on Jul. 31, 2007, now Pat. No. 8,246,720.

(51) Int. Cl.
*B03C 3/06* (2006.01)
*B03C 3/49* (2006.01)

(52) U.S. Cl.
USPC ..... 96/52; 55/DIG. 38; 95/78; 95/79; 96/61; 96/70; 96/71; 96/98

(58) Field of Classification Search
USPC ..... 96/52, 54, 61, 63, 70, 71, 75–78, 95, 96/98; 95/58, 78, 79; 55/DIG. 38
See application file for complete search history.

(56) References Cited

U.S. PATENT DOCUMENTS

| | | | | | |
|---|---|---|---|---|---|
| 2,004,352 | A * | 6/1935 | Simon | 310/308 |
| 3,452,225 | A * | 6/1969 | Gourdine | 310/11 |
| 3,679,973 | A * | 7/1972 | Smith et al. | 324/71.1 |
| 4,734,105 | A * | 3/1988 | Eliasson et al. | 95/62 |
| 5,199,257 | A * | 4/1993 | Colletta et al. | 96/76 |
| 5,439,513 | A * | 8/1995 | Periasamy et al. | 96/25 |
| 5,951,742 | A * | 9/1999 | Thwaites et al. | 95/57 |
| 7,252,810 | B2 * | 8/2007 | Parsa | 422/186.04 |
| 7,758,316 | B2 * | 7/2010 | Bonne et al. | 417/48 |
| 8,246,720 | B2 * | 8/2012 | Pant et al. | 95/58 |
| 2004/0065594 | A1 * | 4/2004 | Parsa | 209/400 |
| 2011/0277632 | A1 * | 11/2011 | Pant et al. | 95/57 |

FOREIGN PATENT DOCUMENTS

| | | | | |
|---|---|---|---|---|
| JP | 56-130208 A | * | 10/1981 | 96/66 |

* cited by examiner

*Primary Examiner* — Richard L Chiesa
(74) *Attorney, Agent, or Firm* — Maschoff Brennan

(57) ABSTRACT

An apparatus for concentrating aerosol particles can include: a sample air inlet; an enriched aerosol outlet; an aerosol lean outlet; a flow path connecting the air inlet and aerosol rich and aerosol lean outlets; and a plurality of alternately energized and grounded electrode pairs along the flow path. The aerosol rich outlet can be in fluid communication with an aerosol particle capture device. The apparatus can include a sheath air inlet providing a flow of aerosol free air over surfaces of the alternately energized and grounded electrode pairs. The apparatus can include an elongate focusing chamber having a cylindrical shape containing the alternately energized and grounded electrode pairs that are configured as circular rings. The apparatus can include one or more structures configured to impart tangential, spiral or helical flow to a stream entering through the sample air inlet.

20 Claims, 6 Drawing Sheets

ELECTROSTATIC AEROSOL CONCENTRATOR

CROSS-REFERENCE TO RELATED APPLICATIONS

This patent application is a continuation application of U.S. patent application Ser. No. 11/831,613, now U.S. Pat. No. 8,246,720, which was filed on Jul. 31, 2007, which patent application is incorporated herein by specific reference in its entirety.

STATEMENT REGARDING FEDERALLY SPONSORED RESEARCH OR DEVELOPMENT

The U.S. Government has rights in this invention pursuant to Contract Number NBCHC060091.

INCORPORATED-BY-REFERENCE OF MATERIAL SUBMITTED ON A COMPACT DISC

Not Applicable

BACKGROUND OF THE INVENTION

1. Field of the Invention

The present invention related to the concentration of aerosol particles and their collection for analysis. In particular, the invention is an air-to-air electrostatic aerosol concentrator that facilitates the collection of aerosol particles for analysis.

2. Description of Related Art

Existing integrated bioaerosol detection systems employ a two-step process in which microorganism-containing aerosol particles are collected and targets of interest are detected. Requirements for these two separate steps, however, are divergent and often conflicting. Most bio-analytical systems used for detection are based on liquid samples, and perform highly sensitive analysis on small sample volumes in the range of nanoliters to microliters, whereas bioaerosol samplers collect aerosols in liquid volumes of 1-10 ml or more. This difference between the sampling and sensing volumes can lead to false alarms, reduced sensitivity and increased logistical burden. While sample volumes may be reduced after bioaerosol collection, this adds significantly to the cost and complexity of the detection system. An improved aerosol concentration and collection system, which directly samples aerosol particles in small analysis volumes, is needed.

Conventional air-to-air aerosol concentration techniques are largely based on inertial mechanisms such as aerodynamic lenses, cyclones, and classical or virtual impactors. Use of these mechanisms, however, often includes high impaction losses in the flow modification region, low enrichment of particles, especially for particles <2 μm in diameter, low viability of microorganisms, and high cost of operation and manufacturing. Sample loss due to impingement in impactors can lead to poor detection sensitivity and high signal-to-noise ratios leading to false alarms. In addition, inertial systems lack flexibility and require significant redesign if specifications such as sampling parameters are altered.

Electrostatics-based concentration is an alternative to traditional inertial concentration technologies in which an externally applied electric field manipulates aerosol particles having native or induced charges into a smaller volume. Electrostatics-based concentration requires significantly less power than inertial systems and high-efficiency concentration and sampling can be achieved while maintaining the viability of biological aerosols. Furthermore, an electrostatic concentration method can be configured to distinguish between biological and non-biological particulates and operating conditions can be altered to select for particular particle fraction based on charge, size, and/or density, for example.

Current electrostatics-based technologies are typically directed toward the removal of particles from air or to augment inertial mechanisms. No existing devices use electrostatics to focus aerosol particles from an air stream into a smaller volume or to concentrate aerosol particles to form a high concentration aerosol.

BRIEF SUMMARY OF THE INVENTION

In one aspect, the present invention is an apparatus that uses electrostatic forces to focus aerosol particles in an air stream. In another aspect, the invention is an apparatus and method for concentrating aerosol particles. In yet another aspect, the invention is an apparatus and method for collecting aerosol particles in a very small volume of liquid.

DETAILED DESCRIPTION OF THE INVENTION

The term "aerosol" as used herein is an airborne liquid, solid, or suspension and includes bacteria, molds, viruses, and spores. The term "aerosol particle" is used to describe a single solid particle, a liquid droplet, or a droplet of suspension. "Viability" of biological sample is used herein to describe the ability of a living organism or a virus to reproduce when placed in appropriate culture media.

Figure 1:
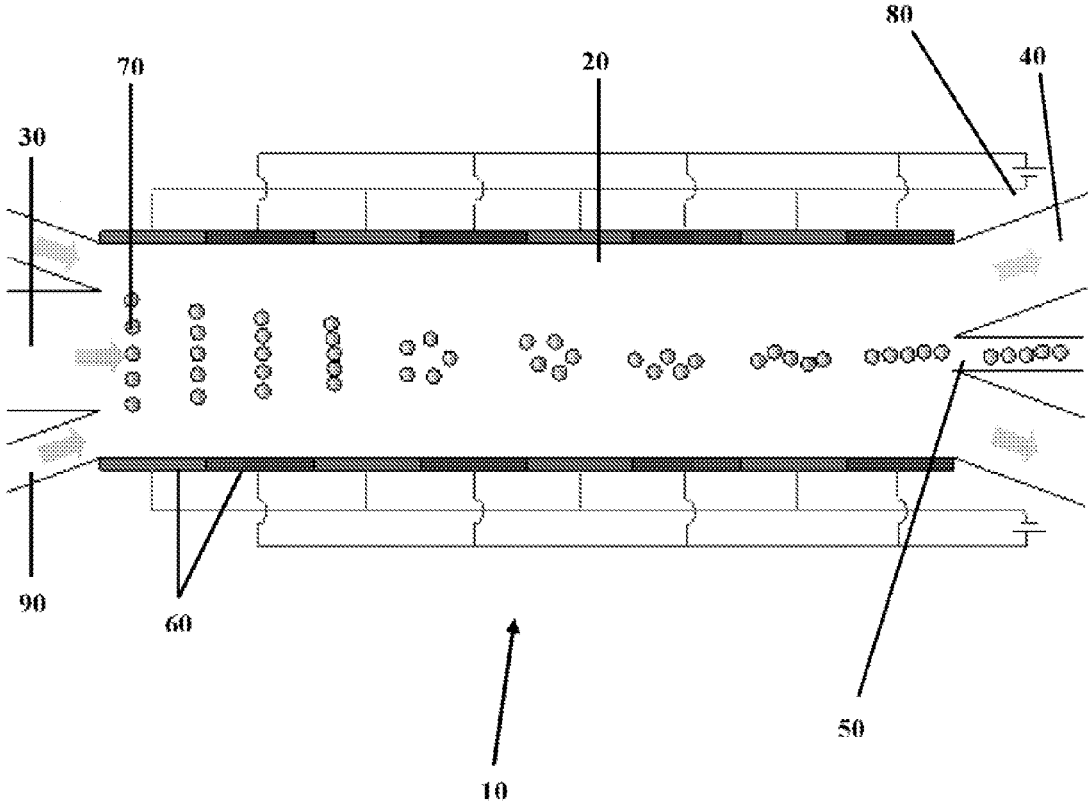
FIG. 1 is a longitudinal cross-section view of the basic design of one embodiment of an apparatus that uses electrostatic forces for focusing and concentrating aerosol particles.

A transverse cross-section of a basic design for an apparatus for electrostatically enhanced air-to-air concentration is shown in FIG. 1. The concentrator 10 comprises an airflow chamber 20 comprising an aerosol inlet 30, an aerosol lean outlet 40, and an aerosol rich outlet 50. The wall of airflow chamber 20 comprises alternately energized and grounded electrode elements 60 that are arranged to work in concert to impart radial inward motion to charged particles 70, thereby focusing the particles toward aerosol rich outlet 50. The embodiment in FIG. 1 comprises rings of electrodes 60 alternately connected to ground 80 and separated by small gaps (not shown). If desired, optional filtered air inlets 90 may be used to provide a sheath of aerosol-free air along the chamber periphery and prevent deposition of particles onto electrode surfaces. The electrical forces generated by individual electrodes may move particles toward or away from the centerline of the airflow chamber 20, but the net effect of the forces is to direct particles toward the centerline. This is primarily caused by particle inertia and non-uniformity in the electric field along the chamber radius, which causes the particles to deviate from flow streamlines and reach the core of the flow. Aerosol particles entering airflow chamber 20 may carry a positive or negative charge naturally, or a positive or negative charge may be induced on the particles using a charging section located upstream of aerosol inlet 30. Natural or induced charges on the aerosol particles may be used to selectively concentrate subpopulations of aerosol particles from a mixture of particles. For example, bacterial spores or aerosolized viruses may be selectively enriched without concentrating other aerosol particles. The particles of interest are focused and collected at the aerosol rich outlet in a small air volume, while the majority of the airflow, stripped of particles of interest, is purged to the atmosphere through aerosol lean outlet 40.

The concentration chambers can be made out of any suitable material such as machinable plastic such as high density PVC, chlorinated PVC, or Plexiglas™ or other suitable material. The upstream end of the concentration chamber and the chamber itself can have any cross-sectional shape including circular, oval, rectangular, triangular, and hexagonal. Circular cross-sectional shape is preferred, in part to be compatible with standard PVC pipe fittings. The electrodes may be fabricated from high electrical conductivity, inert material such as stainless steel, hardened aluminum, gold, copper, or platinum.

Figure 2:
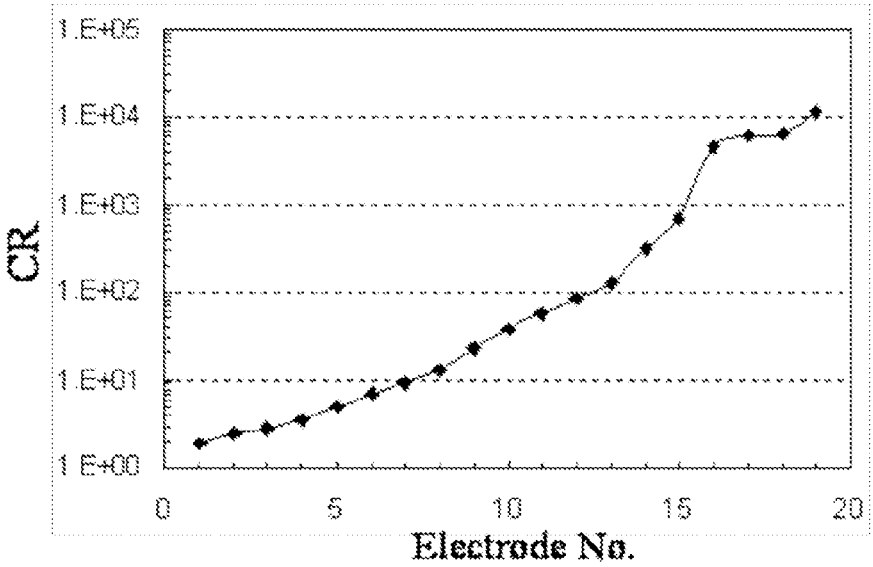
FIG. 2 is a graph showing the relationship between concentration ratio (CR) and the number of electrodes for one embodiment of the aerosol concentrator.
Figure 3:
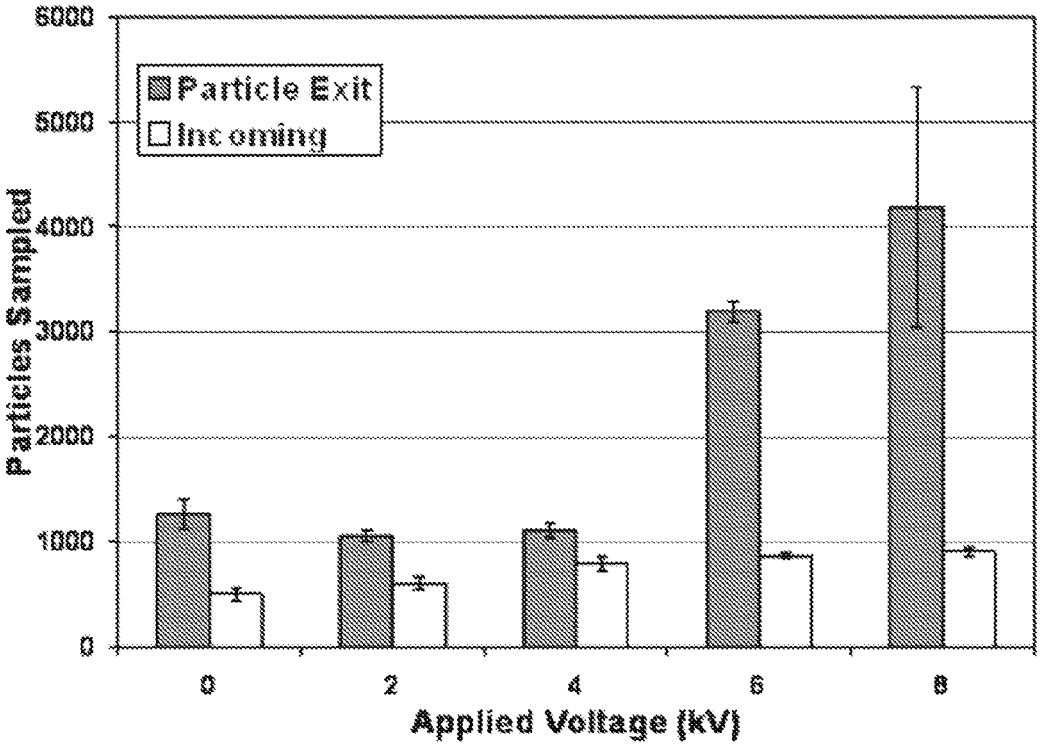
FIG. 3 is a graph showing the relationship between particle, enrichment and the potential voltage applied to the electrodes for one embodiment of the aerosol concentrator.

The number of electrodes influences the operation and efficiency of the aerosol concentrator. Analysis of concentrator operational performance using physics based computational simulations shows that concentration efficiency increases nearly exponentially with the number of electrode pairs (FIG. 2). Electrode size and spacing are also important parameters for concentrator design. In general, small electrode size and spacing lead to lower electric potential requirements to generate the focusing field. Computational modeling also shows that particle enrichment efficiency increases with the potential applied to the electrodes. The trend has also been shown experimentally using a prototype device (FIG. 3).

Figure 4:
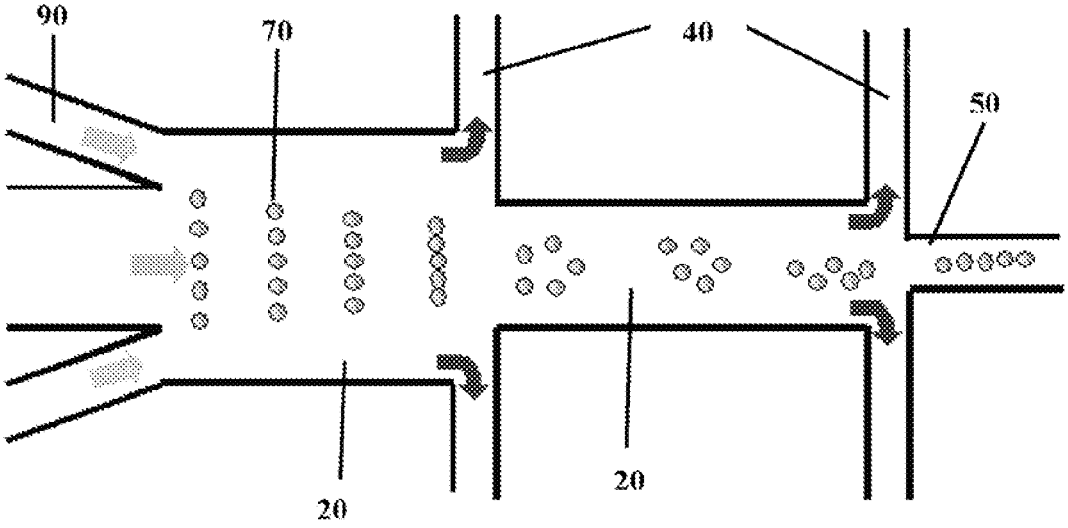
FIG. 4 illustrates the design of an apparatus comprising aerosol concentrator segments arranged in series.

Physics-based computational simulations of the electrostatics-based concentrator have indicated that 1,000-10,000× aerosol enrichment ratios for flow rates up to 5 L/min can be achieved using one embodiment of the present invention for particles ranging in size from 0.5-10 μm in diameter. Air how rates of 100 L/min or more and concentration ratios of 1,000× or more can be achieved using the present invention by employing banks of multiple individual units arranged in series (staged) or parallel. FIG. 4 illustrates the design of an apparatus comprising aerosol concentrator segments arranged in series.

Figure 5:
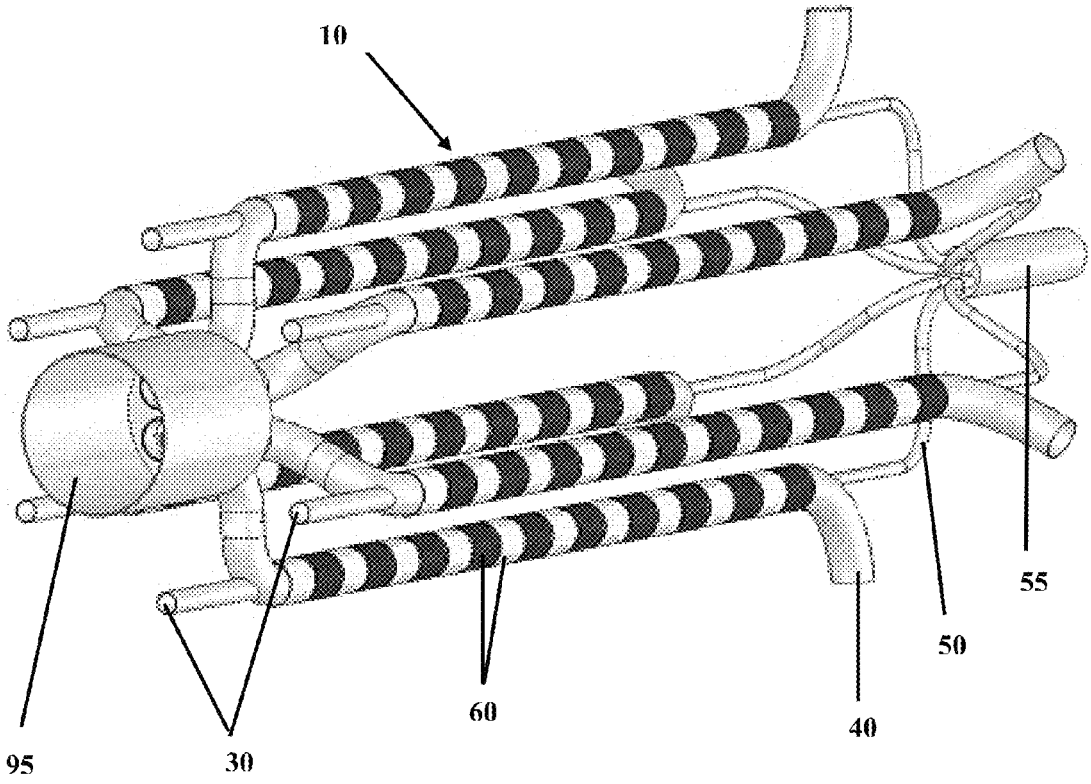
FIG. 5 shows an embodiment of modular concentrator units arranged in parallel in an array format.

One embodiment of modular concentrator units arranged in parallel in an array format is shown in FIG. 5. The individual units in the parallel configuration may comprise optimized single units or staged configuration units as shown in FIG. 4. Filtered air for the filtered air inlets 90 is provided by a central air intake and filter 95. Concentrated aerosol collected by individual concentrator elements 10 at aerosol rich outlets 50 are conveyed to a central aerosol rich, or concentrated aerosol, outlet 55.

Figure 6:
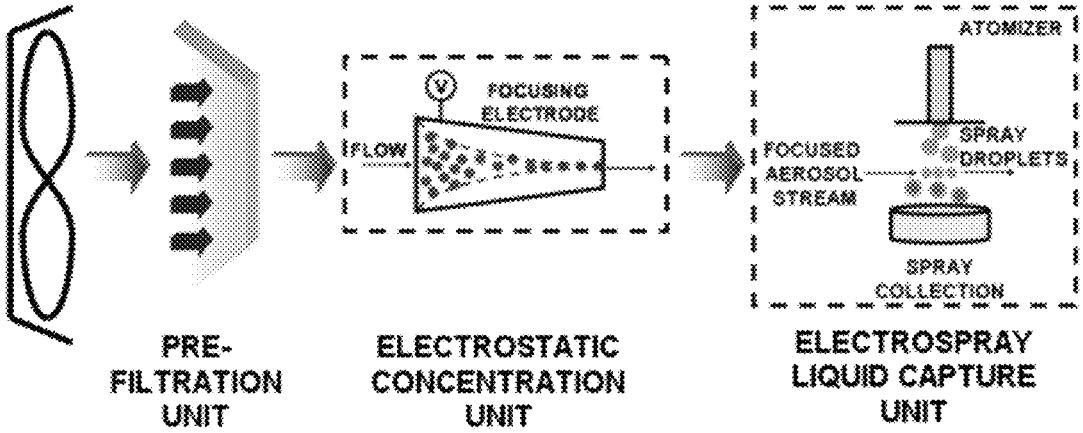
FIG. 6 illustrates the layout of an apparatus for concentrating and collecting aerosol particles according to the present invention.

An electrostatic aerosol concentrator can be coupled to an aerosol particle capturing device for particle capture in small liquid volume and subsequent analysis. For example, an electrostatic-based air-to-air concentrator that focuses airborne pathogenic microbes from a large sample volume of air into a smaller target volume can be coupled to an electrospray aerosol capture device that captures the focused particulates into a small volume of non-evaporating liquid. A layout for such an arrangement is shown in FIG. 6.

Figure 7:
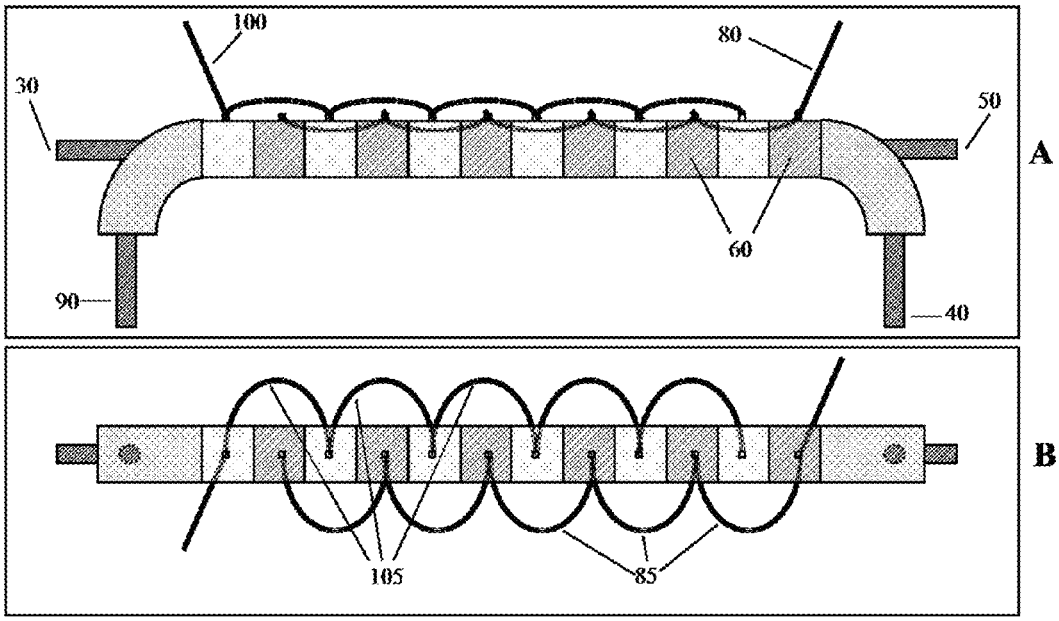
FIGS. 7A and 7B are photographs of side and top views of a prototype electrostatic aerosol concentrator.

Prototype and Air-to-Air Aerosol Concentration:

Experimental testing carried out with a concentrator prototype yielded particle concentration ratios of 5× (FIG. 3). FIG. 7A is a photographic side view of the prototype device. Ground outlet lead 80 and high voltage lead 100 are shown. FIG. 7B is a photographic top view of the same device with high voltage electrode connection 105 and ground electrode connections 85 shown. The airflow chamber is approximately 25 cm in length and 1.2 cm in diameter and comprises 10 pairs of 10 mm wide circular electrodes.

Example of Computational Simulations:

High-fidelity simulations were performed using CFD-ACE-+® (ESI Group) and validated computational models to demonstrate the potential for obtaining concentration ratios as high as 1,000-10,000× and high retention efficiencies at moderate sampling rates.

Airflow was described by the conservation of mass (continuity) and Naviér-Stokes equations (momentum) for Newtonian incompressible flow, which are given by, $$\nabla\cdot(\rho u)=0\ u\cdot\nabla(\rho u)=-\nabla p+\nabla\cdot(\mu\nabla u) \tag{1}$$

where ρ and μ are the fluid density and dynamic viscosity respectively, and u and p are the airflow velocity and pressure fields, respectively.

Electric field is solved using Gauss' Law $$\nabla\cdot(\epsilon_r\epsilon_0\nabla\phi)=-\rho_c \tag{2}$$

where $\phi$ is the electric potential; $\rho_c$ is the volumetric charge density; $\epsilon_0$ is the permittivity of a vacuum; and $\epsilon_r$ is the medium's relative permittivity. In the example, the aerosol particles occupy a small portion of the entire airflow volume and their effects on medium permittivity were therefore ignored$_r$.

Particle transport is modeled by solving the particle equation of motion in a Lagrangian reference frame.

$$\frac{\partial v_i}{\partial t}=\frac{f}{\tau_v}(u_i-v_i)+\frac{qE}{m} \tag{3}$$

Here v is the aerosol particle velocity; f is the drag factor; q and in is the carried charge and mass of the aerosol particle; E is the electric field in the concentrator; and $\tau_r$ is the particle relaxation time. Particle losses due to deposition onto the walls/electrodes are primarily governed by inertial, electrostatic and gravitational forces. These deposition mechanisms are inherently accounted for in the particle transport model. For conservative evaluation, it is assumed that the particle is lost once it comes in contact with the wall. The particle tracking models used in CFD-ACE+® also account for stochastic transport using the well-known Brownian model.

Design analysis has shown that the concentrator design is capable of achieving concentration ratios >1,000× while maintaining high sample retention efficiencies at sampling rates of ~5 L/min for aerosol particles in the range of 1-10 μm in diameter. Concentration ratios of ~10,000× are attained when the aerodynamic and electrostatic forces are balanced through careful design of the air/particle flow rate and voltage.

The performance of concentrator designs can be characterized using two different performance metrics: Concentration Ratio (CR) and Retention Ratio (RR). The CR is the ratio of the particle concentration at the concentrator outlet to that at the inlet, and the RR is defined as the ratio of the particle number at the outlet to that at the inlet, as shown below:

$$CR = \frac{N_{out}/Q_{out}}{N_{in}/Q_{in}} \tag{4}$$

$$RR = \frac{N_{out}}{N_{in}}$$

where subscripts "in" and "out" represent the quantities at the inlet and outlet of the concentrator chamber, N is the number of particles, Q is the airflow rate enclosed by the particle furthest from the axial chamber centerline. In addition, an index of Power Expenditure (PE) can be defined as the sum of the mechanical power and the electrical energy needed to supply the focusing potential:

$$PE = Q\Delta p + A_e I \Delta V \tag{5}$$

where Q and ΔP is the sampling airflow rate and pressure drop through the concentrator; ΔV is the potential difference across the adjacent electrodes, $A_e$ is the area of the electrodes, and I represents the current density at the electrodes.

Given the diversity of physical and operational parameters, it is useful to obtain operational envelopes and design rules for the electrostatic concentrator in terms of non-dimensional parameters. The particle equation of motion can be non-dimensionalized to obtain dimensionless groups related to concentrator performance $$\frac{dv'}{dt'} \frac{1}{St}(u' - v') + \frac{1}{SEt}E' \tag{6}$$

where u', v' and t' are dimensionless air velocity, particle velocity, and time, respectively. St is the classical Stokes number, signifying to what degree the particle can be separated from the flow. SEt, the electrostatic Stokes number, denotes the contribution of the electrostatic force to particle acceleration. Similarly, normalization of flow and electrostatics equation introduces the Reynolds number (Re) and concentrator geometry into the equation (via u' and E'):

$$CR = f(St, SEt, Re, \gamma) \quad RR = f(St, SEt, Re, \gamma) \tag{7}$$

where γ represents the non-dimensionalized geometric parameters associated with the concentrator. Parametric simulational analyses based on these dimensionless parameters, can be used to predict performance.

Optimization of the concentrator for a particular application, including the geometric parameters of the concentrator, is independent on the operating conditions and physico-chemical parameters. Operating parameters for concentrator performance include airflow rate, particle size, and electrode potential. Physico-chemical parameters include particle size, charge, and electrical permittivity. Concentrator design depends on a combination of complex, non-linear interactions, which can affect the system performance in a non-intuitive manner. Therefore, multi-physics computational analysis was to evaluate the trade-offs among various design parameters and to provide guidance for design development.

Figure 8:
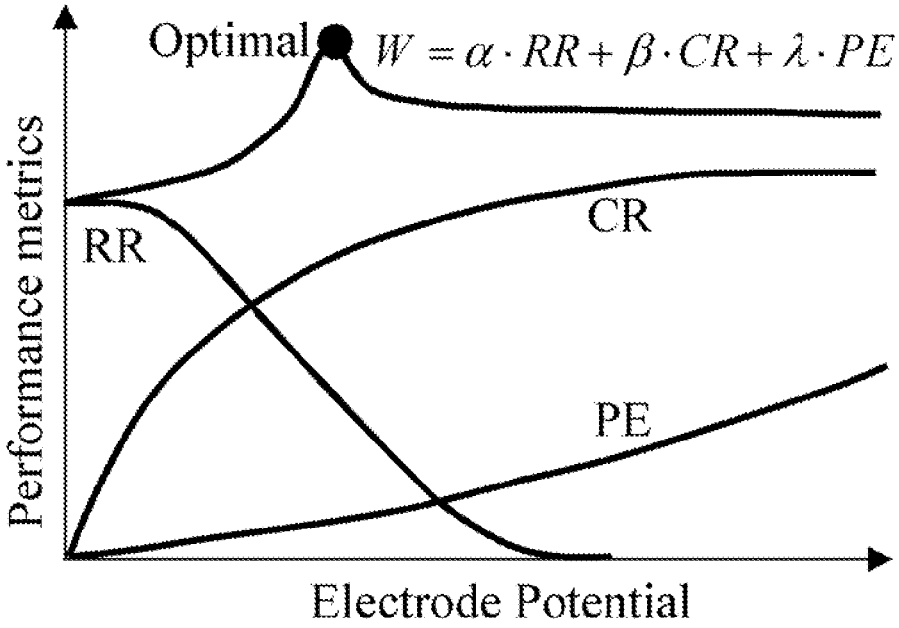
FIG. 8 is a graph showing the calculated relationships between four concentrator performance measures with increasing electrode potential.
Figure 9:
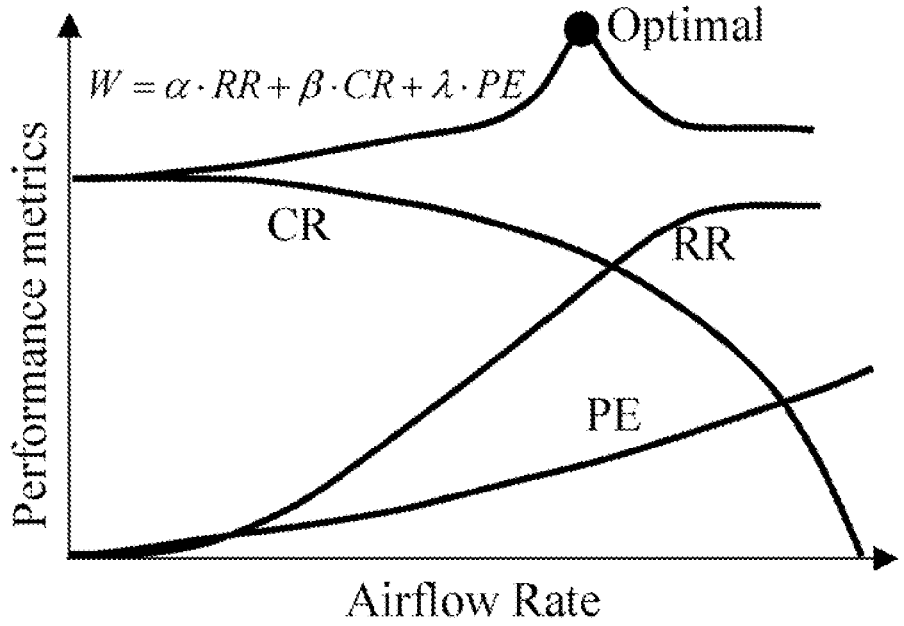
FIG. 9 is a graph showing the calculated relationships between four concentrator performance measures with increasing airflow rate.

Toward this end, the overall Performance index (W) can be defined as the weighted average of CR, RR, and PE:

$$W = \alpha \cdot RR + \beta \cdot CR + \lambda \cdot PE \tag{8}$$

where α and β are dimensionless constants and λ is a negative constant with dimension of reciprocal of power (watts$^{-1}$). A large value of W indicates a candidate design promises excellent performance in concentration ratio, retention ratio, and power consumption. FIG. 8 and FIG. 9 are graphs showing the relationships between performance parameters and increasing electrode potential and airflow rate, respectively.

What is claimed is:

1. An apparatus for concentrating aerosol particles comprising:

a sample air inlet;

an enriched aerosol outlet;

an aerosol lean outlet;

a flow path connecting the air inlet and aerosol rich and aerosol lean outlets; and a plurality of alternately energized and grounded electrode pairs along the flow path.

2. The apparatus of claim 1, wherein the aerosol rich outlet is in fluid communication with an aerosol particle capture device.

3. The apparatus of claim 1, further comprising a sheath air inlet providing a flow of aerosol free air over surfaces of the alternately energized and grounded electrode pairs.

4. The apparatus of claim 1, comprising an elongate focusing chamber having a cylindrical shape containing the alternately energized and grounded electrode pairs that are configured as circular rings.

5. The apparatus of claim 1, comprising one or more structures configured to impart tangential, spiral or helical flow to a stream entering through the sample air inlet.

6. The apparatus of claim 1, comprising an ionization electrode located near the sample air inlet and configured to ionize aerosol particles.

7. The apparatus of claim 1, wherein the sample air inlet is operably coupled to an airflow inducing member.

8. The apparatus of claim 1, comprising a power supply programmed to variably energize the alternately energized and grounded electrode pairs.

9. The apparatus of claim 1, comprising a transceiver operationally connected to the concentrating apparatus for controlling the operation of the apparatus in response to received signals and sending information from the device to a remote location.

10. The apparatus of claim 1, wherein the aerosol lean outlet is at an angle from the enriched aerosol outlet.

11. The apparatus of claim 1, comprising:

the aerosol rich outlet in fluid communication with an aerosol particle capture device;

a sheath air inlet providing a flow of aerosol free air over surfaces of the alternately energized and grounded electrode pairs;

an elongate focusing chamber having a cylindrical shape containing the alternately energized and grounded electrode pairs that are configured as circular rings;

one or more structures configured to impart tangential, spiral or helical flow to a stream entering through the sample air inlet;

an ionization electrode located near the sample air inlet and configured to ionize aerosol particles; and a power supply programmed to variably energize the alternately energized and grounded electrode pairs.

12. The apparatus of claim 1, comprising:

a plurality of elongate focusing chambers, each elongate focusing chamber comprising:

a sample air inlet;

an enriched aerosol outlet;

an aerosol lean outlet;

a flow path connecting the air inlet and aerosol rich and aerosol lean outlets; and a plurality of alternately energized and grounded electrode pairs along the flow path; and the plurality of elongate focusing chambers being arranged in series such that the enriched aerosol outlet of a first elongate focusing chamber is connected to the sample air inlet of a second focusing chamber.

13. The apparatus of claim 12, comprising one or more of the following:

the aerosol rich outlet of the last elongate focusing chamber of the series being in fluid communication with an aerosol particle capture device;

a sheath air inlet providing a flow of aerosol free air over surfaces of the alternately energized and grounded electrode pairs of at least one elongate focusing chamber;

each elongate focusing chamber having a cylindrical shape containing the alternately energized and grounded electrode pairs that are configured as circular rings;

one or more structures configured to impart tangential, spiral or helical flow to a stream entering through the sample air inlet of one or more of the elongate focusing chambers;

an ionization electrode located near the sample air inlet of one or more of the elongate focusing chambers and configured to ionize aerosol particles; or a power supply programmed to variably energize the alternately energized and grounded electrode pairs of each elongate focusing chamber.

14. The apparatus of claim 1, comprising:

a plurality of elongate focusing chambers, each elongate focusing chamber comprising:

a sample air inlet;

an enriched aerosol outlet;

an aerosol lean outlet;

a flow path connecting the air inlet and aerosol rich and aerosol lean outlets; and a plurality of alternately energized and grounded electrode pairs along the flow path;

an aerosol particle capture device having an inlet; and the plurality of elongate focusing chambers arranged in parallel such that the enriched aerosol outlet of each focusing chamber is connected to the inlet of the aerosol particle capture device.

15. The apparatus of claim 14, comprising one or more of the following:

each aerosol rich outlet in fluid communication with an aerosol particle capture device;

each elongate focusing chamber having a sheath air inlet providing a flow of aerosol free air over surfaces of the alternately energized and grounded electrode pairs;

each elongate focusing chamber having a cylindrical shape containing the alternately energized and grounded electrode pairs that are configured as circular rings;

one or more structures configured to impart tangential, spiral or helical flow to a stream entering through the sample air inlet of one or more of the elongate focusing chambers;

an ionization electrode located near the sample air inlet of one or more of the elongate focusing chambers and configured to ionize aerosol particles; or a power supply programmed to variably energize the alternately energized and grounded electrode pairs of each elongate focusing chamber.

16. A method for collecting an aerosol from air, the method comprising:

obtaining the apparatus of claim 1, focusing a stream of aerosol particles with the plurality of alternately energized and grounded electrodes; and collecting the focused aerosol particles.

17. The method of claim 16, the method comprising:

using electrostatics to focus the stream of aerosol particles from an air stream having the aerosol particles into a smaller volume so as to concentrate the aerosol particles.

18. The method of claim 16, the method comprising:

imparting radial inward motion to charged particles of the aerosol particles.

19. A method for collecting an aerosol from air, the method comprising:

obtaining the apparatus of claim 12, focusing a stream of aerosol particles with the plurality of alternately energized and grounded electrodes of each elongate focusing chamber; and collecting the focused aerosol particles.

20. A method for collecting an aerosol from air, the method comprising:

obtaining the apparatus of claim 14, focusing a stream of aerosol particles with the plurality of alternately energized and grounded electrodes of each elongate focusing chamber; and collecting the focused aerosol particles.

* * * * *